US005347727A

United States Patent [19]

Kim

[11] Patent Number: 5,347,727

[45] Date of Patent: Sep. 20, 1994

[54] METHOD FOR CONTROLLING COMBINED SENSING TYPE CLOTHES DRYER

[75] Inventor: Sang D. Kim, Kyungsangnam-Do, Rep. of Korea

[73] Assignee: Goldstar Co., Ltd., Rep. of Korea

[21] Appl. No.: 994,519

[22] Filed: Dec. 21, 1992

[30] Foreign Application Priority Data

Dec. 23, 1991 [KR] Rep. of Korea ..... 23993/1991

[51] Int. Cl.[5] ..... F26B 3/02

[52] U.S. Cl. ..... 34/491; 34/495; 34/535; 34/549; 34/565

[58] Field of Search ..... 34/43, 44, 46, 48, 50, 34/53, 54, 55, 26, 29, 30, 133 J, 133 L, 22, 13

[56] References Cited

U.S. PATENT DOCUMENTS

| | | | |
|---|---|---|---|
| 4,485,566 | 12/1984 | Vivares | 34/44 |
| 4,738,034 | 4/1988 | Muramatsu et al. | 34/48 |
| 5,161,314 | 11/1992 | Souza | 34/48 |
| 5,172,490 | 12/1992 | Tatsumi et al. | 34/54 |

*Primary Examiner*—Denise L. Gromada

*Attorney, Agent, or Firm*—Ostrolenk, Faber, Gerb & Soffen

[57] ABSTRACT

A method for controlling a drying operation of a combined sensing type clothes dryer including a drum, a heat exchanging fan, a motor, a heater, a temperature sensor and a humidity sensor, the sensors being disposed between the drum and the heat exchanging fan, comprising the steps of calculating an average value of the sum of a temperature variation per unit time detected by the temperature sensor and a humidity value sensed by the humidity sensor, both of which is detected when a predetermined time ($t_{SH}$) has been elapsed from the beginning of the drying operation, determining the fabric quantity of clothes as one of a small fabric quantity, a large fabric quantity and an excessive fabric quantity, based on the calculated average value, and controlling the drying operation, based on the determined fabric quantity. Taking into consideration the ambient temperature, the fabric quantity is determined, thereby capable of preventing an occurrence of an error of the fabric quantity determination.

13 Claims, 13 Drawing Sheets

METHOD FOR CONTROLLING COMBINED SENSING TYPE CLOTHES DRYER

BACKGROUND OF THE INVENTION

1. Field of the Invention

The present invention relates to a method for controlling a clothes dryer, and more particularly to a method for controlling a combined sensing type clothes dryer, capable of preventing an excessive or insufficient drying encountered in single sensing type using temperature sensors or humidity sensors.

2. Description of the Prior Art

Referring to FIG. 1, there is illustrated a general construction of clothes dryer. As shown in FIG. 1, the clothes dryer comprises an outer case 1, a drum 2 rotatably disposed in the outer case 1, and a motor 4 fixedly mounted to the inner wall of outer case 1 above the drum 2 to generate a torque. The torque of the motor 4 is transmitted to the drum 2 via a drum belt 3, to rotate the drum.

The drum 2 has at its front portion a door 14 and a plurality of holes for introducing hot wind in the drum 2. A heater 13 for emitting a heat is disposed forwardly of the drum 2. A plurality of vent holes are formed at the rear wall surface of the drum 2, for venting air with vapor. Inwardly of the vent holes, a filter assembly 15 is attached to the rear portion of the drum 2, so as to separate bits of thread from the air and vapor exhausted out of the drum 2.

A heat exchanging fan 7 is also rotatably mounted, rearwardly of the drum 2. The fan 7 is rotated by receiving the torque from the motor 4 via a fan belt 6. A plurality of vent holes 5 are also formed at the outer case 1, so as to introduce air into the outer case and vent air out of the outer case.

A duct 11 is disposed beneath the drum 2. The duct 11 provides a passage of circulating hot wind extending from the rear portion of the drum 2 to the interior of drum 2 via the heater 13. Accordingly, the hot wind exhausted out of the rear portion of drum 2 is heat-exchanged with outer cold air by the function of the fan 7 and then fed to the interior of drum 2, via the heater 13. A drain port 10 is also provided at a desired portion of the duct 11, outwardly of the outer case 1. Through the drain port 10, condensed water generated during the heat exchange is drained outwardly.

Control for a drying operation of the general clothes dryer with the above-mentioned construction can be conventionally achieved according to two control methods one of which is a temperature sensing type wherein the drying operation is controlled, based on the intake air temperature and the exhaust air temperature of the drum 2 detected by two temperature sensors 9 and 12 attached to the drum 12 and the other of which is a humidity sensing type wherein the drying operation is controlled, based on the humidity detected by the humidity sensor 8 attached to the rear surface of the drum 2, in place of the temperature sensors 9 and 12.

Referring to FIG. 2, there is illustrated a control device for controlling the drying operation of the temperature sensing type clothes dryer. As shown in FIG. 2, the control device comprises an electric power supply unit 21 for supplying electric power to required units of the dryer, a first temperature sensing unit 22 and a second temperature sensing unit 23 for converting, into electric signals, the temperature detection values indicative of the exhaust air temperature and the intake air temperature of the drum 2 detected by two temperature sensors 9 and 12 attached to the drum 12, respectively, an A/D converter 24 for converting the sensing signals from the first and second temperature sensing units 22 and 23 into digital signals, a microcomputer 25 for carrying out the control for the drying operation, based on the sensed temperature values from the A/D converter 24, and a load driving unit 26 for driving the motor 4 and the heater 13, under the control of the microcomputer 25.

In FIG. 2, the same elements as those shown in FIG. 1 such as the motor 4, the temperature sensors 9 and 12 and the heater 13 are denoted by the same reference numerals.

On the other hand, FIG. 3 is a circuit diagram of a control device for controlling the drying operation of the humidity sensing type clothes dryer. As shown in FIG. 3, the control device comprises an electric power supply unit 21 for supplying electric power to required units of the dryer, a humidity sensing unit 27 for converting, into electric signals, the humidity detection value indicative of the exhaust air humidity of the drum 2 detected by the humidity sensor 8, an A/D converter 24 for converting the sensing signal from the humidity sensing units 27 and 23 into a digital signal, a microcomputer 25 for carrying out the control for the drying operation, based on the sensed humidity value from the A/D converter 24, and a load driving unit 26 for driving the motor 4 and the heater 13, under the control of the microcomputer 25.

In FIG. 3, the same elements as those shown in FIG. 1 such as the motor 4, the humidity sensor 8 and the heater 13 and as those shown in FIG. 2 such as the electric power supply unit 21, the A/D converter 24, the microcomputer 25 and the load driving unit 26 are denoted by the same reference numerals.

Now, the drying operation of the clothes dryer will be described, in conjunction with the control operations according to the control devices of the above-mentioned types.

When the dryer is operated after the user puts clothes into the drum 2, the microcomputer 25 turns on the motor 4 and the heater 13 via the load driving unit 26.

As the motor 4 is driven, its torque is transmitted to the drum 2 via the drum belt 3 so that the drum 2 rotates at a relatively low and uniform rate. Simultaneously, the torque motor 4 is also transmitted to the heat exchanging fan 7 via the fan belt 6, so as to rotate the heat exchanging fan 7.

Accordingly, the heater 13 emits heat which is, in turn, supplied to the interior of the drum 2. As a result, the internal temperature of the drum 2 increases and the moisture contained in the clothes is evaporated and exhausted out of the drum 2 via the filter assembly 15. The air exhausted out of the drum 2 undergoes an heat exchange with outer cold air introduced into the outer case 1 by the rotation of heat exchanging fan 7. By the heat exchange, the vapor contained in the warm exhaust air is condensed into water which is, in turn, discharged out of the drain port 10 along the duct 11. The exhaust air from which the moisture is separated is then fed to the heater 13, so as to be circulated to the drum 2 at a heated state. As the drying operation is continued for a predetermined period of time in a manner as mentioned above, the moisture contained in the clothes is continuously evaporated. With the lapse of time, the evaporation amount is gradually increased.

The drying operation is carried out in a manner as mentioned above. Where such a drying operation is controlled by the temperature sensing type control method, the first temperature sensor 9 attached to the rear surface of drum 2 detects the temperature of the exhaust air and the second temperature sensor 12 disposed near the heater 13 detects the temperature of the intake air which has been free of the vapor, but does not pass the heater 13 yet. In this case, the drying operation is controlled by controlling turning on/off of the heater 13, based on the detected intake air temperature and the detected exhaust air temperature.

With the lapse of drying operation time, for example, the detected temperatures by the temperature sensors 9 and 12 are increased due to the heat emission of the heater 13, as shown in FIGS. 4 and 5. When a predetermined period of time has elapsed, the heat amount emitted from the heater 13 and the evaporation amount become constant, thereby causing the variation in temperature detected from the temperature sensors 9 and 12 to be constant. That is, a constant drying interval occurs at the point of time when the variation in temperature becomes constant. Such a constant drying interval does not occur, when the drying load, namely, the fabric quantity of clothes to be dried is small.

FIG. 4 shows temperature curves S1 and S2 which illustrate the variations in temperature detected by the temperature sensors 9 and 12, depending on the drying time, in cases of small and large fabric quantities, respectively. The patterns 1 of FIG. 4 show the cases when the fabric quantity is small. In these cases, the evaporation amount is small relative to the emitted heat amount of the heater 13, so that the exhaust air temperature is rapidly increased and thereby reaches the control temperature $T_{peak}$ of the heater 13. That is, the time tw taken to reach the control temperature $T_{peak}$ is lesser for a smaller fabric quantity.

On the other hand, the patterns 2 of FIG. 4 show the cases when the fabric quantity is large. In these cases, the evaporation amount is slowly increased at the early stage of the drying operation, so that the detected temperatures by the temperature sensors 9 and 12 are increased. When the heat amount emitted from the heater 13 and the evaporation amount become constantly proportional to each other, the detected temperatures by the temperature sensors 9 and 12 become constant. In the pattern 2, the curve S1 shows the variations in temperature sensed by the first temperature sensor 9, whereas the curve S2 shows the variations in temperature sensed by the second temperature sensor 12.

As the moisture quantity of the clothes is suddenly reduced, the exhaust air temperature is increased. At this time, the temperature curve S2 indicating the temperature sensed by the second sensor 12 has an increasing gradient lower than that of the temperature curve S1 indicating the temperature sensed by the first temperature sensor 9. As a result, the gap between the temperature curves S1 and S2 is increased.

The difference $G_L$ between the temperatures sensed by the temperature sensors S1 and S2 in the pattern 1 of a small fabric quantity is larger than the difference $G_S$ between the temperatures sensed by the temperature sensors S1 and S2 in the pattern 2 of a large fabric quantity.

In accordance with the temperature sensing type control method, therefore, the drying operation time t is checked after the drying operation is begun by turning on the motor 4 and the heater 13, so as to check whether a predetermined time t has been elapsed. When the predetermined time t has elapsed, the temperature S1 of the exhaust air containing vapor and the temperature S2 of the intake air free of the vapor, but not heated by the heater 13 yet are sensed by the temperature sensors 9 and 12, respectively, so that the difference between the exhaust air temperature S1 and the intake air temperature S2 is calculated ($\Delta T = S1 - S2$). Where the temperature difference $\Delta T$ is more than a predetermined value T1 (a constant value calculated experimentally previously and stored) at the point of time when the predetermined time t1 has been elapsed or the exhaust air temperature S1 reach the heater control temperature $T_{peak}$ within the predetermined time t1, the fabric quantity is determined to be small. In this case, a timer operation is carried out, by which the drying operation is achieved for a predetermined time (a reference time calculated experimentally previously and set). Following the timer operation, the heater 13 is turned off and the drum 2 and the fan 7 are rotated for a predetermined time (a time for cooling the heated clothes calculated experimentally previously and set), so as to cool the heated clothes. Thereafter, the motor 4 is turned off, to complete the drying operation.

However, where the exhaust air temperature S1 does not reach the heater control temperature $T_{peak}$ within the predetermined time t1 and the temperature difference $\Delta T$ is not more than a predetermined value T1 at the point of time when the predetermined time t1 has been elapsed, the fabric quantity is determined to be large. In this case, the drying operation is continued and the temperature difference $\Delta T$ sensed by the temperature sensors 9 and 12 is continuously checked. When the temperature difference $\Delta T$ is more than a predetermined value T2, the heater 13 is turned off and only the drum 2 is rotated for a predetermined time (a time for cooling the heated clothes at a large fabric quantity, calculated experimentally previously and set), so as to cool the heated clothes. Thereafter, the motor 4 is turned off, to complete the drying operation. The predetermined value T2 is a constant value calculated experimentally previously and set to correspond to the temperature difference at the point of time when the drying degree is not less than 97% at a large fabric quantity. The predetermined value T2 is more than the predetermined value T1.

On the other hand, in accordance with the humidity sensing type control method, the humidity in the drum 2 is sensed by the humidity sensor 8 attached to the rear surface of drum 2. In the humidity sensing unit 27, the detected value from the humidity sensor 8 is converted into an analog signal which is, in turn, converted into a digital signal by the A/D converter 24. The digital signal is then applied to the microcomputer 25. Accordingly, the microcomputer 25 controls the drying operation, based on the sensed humidity.

In accordance with the humidity sensing type control method, the drying operation is begun as the motor 4 and the heater 13 are turned on and the drum 2 and the fan 7 are rotated, in a manner similar to the temperature sensing type control method. With the lapse of drying operation time, the evaporation amount is gradually increased.

When a predetermined time $t_{H1}$ has been elapsed, for example, the variations in humidity as shown by the patterns 1 and 2 of FIG. 7 occur, depending on the fabric quantity.

Where the fabric quantity is small (pattern 1), the humidity H1 is sharply increased, as compared with the case where the fabric quantity is large (pattern 2). When the predetermined time $t_{H1}$ has been elapsed and the emitted heat amount of the heater 13 and the evaporation amount are constantly proportional to each other, the humidity H1 is kept at predetermined levels $H_8$ and $H_A$ in respective cases of a small fabric quantity and a large fabric quantity (constant humidity interval). Following the constant humidity interval, the evaporation amount, namely, the vapor amount is suddenly reduced, thereby causing the humidity H1 to be sharply decreased. As the humidity H1 is decreased to reach a humidity sensing limit $H_S$, the heater 13 is further driven for a predetermined time. Thereafter, the heater 13 is turned off, to complete the drying operation.

FIG. 8 shows the variation in resistance of the humidity sensor depending on the ambient temperature and the relative humidity. As shown in FIG. 8, the resistance of the humidity sensor is decreased, as the relative humidity increases. Also, the effect of the ambient temperature on the resistance is more increased at a higher relative humidity. The resistance becomes small at a higher ambient temperature and large at a lower ambient temperature. At the relative humidity of 90%, for example, the variation in resistance may be large, depending on the variation in ambient temperature. However, the variation in resistance is very small at the relative humidity of about 10%.

Where the fabric quantity is large as in the pattern 2, the sensed humidity is relatively high, since the area of generating vapor is large, as compared with the pattern 1 with a small fabric quantity. At the large fabric quantity, the decreasing rate of the evaporation amount is low, as compared with the case with small fabric quantity. As a result, a long operation time is required at the large fabric quantity.

In accordance with the drying operation controlling method using the humidity sensor, the drying operation is begun by turning on the motor 4 and the heater 13, as shown in FIG. 9. When the drying operation time t has passed a predetermined time $t_{H1}$, an operation for sensing the humidity H1 is begun and a determination is made about whether the sensed humidity H1 is less than the humidity sensing limit Hs. When the sensed humidity H1 is less than the humidity sensing limit Hs, the time is counted so that the heater 13 and the motor 4 are maintained at their On states, respectively, until a predetermined time (the time taken for the humidity to be 0%) has elapsed. When the predetermined time has been elapsed, the heater 13 is turned off. Thereafter, the drum 2 and the fan 7 are driven again for a predetermined time, so as to cool the heated clothes. Following the cooling operation, the motor 4 is turned off, so as to complete the driving operation.

However, the above-mentioned temperature sensing type and humidity sensing type control methods have various problems. Where the fabric quantity is too large, for example, the temperature difference ΔT sensed by the temperature sensors 9 and 12 increases no longer, even when the drying of clothes has been actually completed. Accordingly, the temperature sensing type control method in which the drying operation is controlled, based on the temperature difference ΔT has a problem of an excessive drying, in that the point of drying completion time can not be found. At a larger fabric quantity, the temperature difference ΔT increases more slowly, thereby resulting in an excessive drying.

This is because the heat from the heater 13 is shielded by the clothes due to the large quantity of clothes and thereby difficult to be transmitted to the vicinity of the first temperature sensor 9. This phenomenon occurs remarkably at a larger fabric quantity or in cases of large volume clothes or blankets.

Even at the same fabric quantity, the temperature difference ΔT (S1−S2) sensed by the temperature sensors 9 and 12, namely, the temperature gap may occur, depending on the ambient temperature. In particular, the temperature difference ΔT increases more at a lower ambient temperature. As a result, the conventional control method wherein the fabric quantity is determined by the temperature gap has a problem of a considerable error in the fabric quantity determination. In some cases, an ambient temperature sensor is additionally provided for sensing the ambient temperature around the dryer. In this case, there is also a problem that the fabric quantity should be determined by compensating the sensed temperature difference, so as to reduce the fabric quantity determination error.

In the humidity sensing type method, the relative humidity can be sensed only within a range of 10% to 90%, as shown in FIG. 8. Beyond the range, the humidity sensing operation becomes inaccurate or impossible. The humidity sensor 8 senses hardly the humidity, at a lower ambient temperature. At the ambient temperature of 0° C., the sensing operation of the humidity sensor 8 is impossible. At a higher ambient temperature, an error increases more, since the humidity of ambient air is high. The humidity is also affected by a generation of gas, the quantity of wind generated by the fan 7 and a vibration.

In cases of commercially available clothes dryer, the humidity sensors are difficult to determine a very small fabric quantity, since the relative humidity ranges from 0% to 10% at the very small fabric quantity. At the fabric quantity, the humidity sensed by the humidity sensor reaches early the humidity sensing limit Hs, so that an insufficient drying state occurs. When the fabric quantity is excessive, the relative humidity may exceed 90%. In this case, it is difficult to determine accurately the fabric quantity by checking the humidity.

SUMMARY OF THE INVENTION

Therefore, an object of the invention is to eliminate the above-mentioned problems encountered in the prior arts and to a method for controlling a combined sensing type clothes dryer, capable of determining a fabric quantity of clothes to be dried, based on variations in temperature and temperature sensed by temperature sensors and a humidity sensor, thereby preventing an excessive drying and an insufficient drying.

Another object of the invention is to provide a method for controlling a combined sensing type clothes dryer, capable of determining a fabric quantity of clothes to be dried, based on an arithmetical mean of the sum of a temperature variation and a humidity value, taking into consideration of an ambient temperature, thereby preventing an occurrence of an error of the fabric quantity determination.

In accordance with one aspect, the present invention provides a method for controlling a drying operation of a clothes dryer including a drum, a heat exchanging fan, a motor, a heater, a temperature sensor and a humidity sensor, the sensors being disposed between the drum and the heat exchanging fan, comprising the steps of: calculating an average value of the sum of a temperature variation per unit time and a humidity value, both of which are detected when a predetermined time ($t_{SH}$) has elapsed from the beginning of the drying operation; determining the fabric quantity of clothes as one of a small fabric quantity, a large fabric quantity and an excessive fabric quantity, based on the calculated average value; and controlling the drying operation, based on the determined fabric quantity.

In accordance with another aspect, the present invention provides a method for controlling a drying operation of a clothes dryer including a drum, a heat exchanging fan, a motor, a heater and a microcomputer for controlling the drying operation, comprising the steps of: turning on the heater and the motor at the beginning of the drying operation and checking a drying operation time t, to determine whether the drying operation time (t) has exceeded a predetermined time ($t_{SH}$); calculating a value (Q) indicative of the fabric quantity, based on a temperature variation ($\Delta X$) per unit time and a humidity value, when the drying operation time t has exceeded the predetermined time ($t_{SH}$); primarily determining whether the fabric quantity corresponds to a small fabric quantity, based on the currently sensed temperature and the temperature variation ($\Delta X$), after the calculation of the fabric quantity value (Q); performing a small fabric quantity-drying operation by turning on/off the motor for a predetermined time, when the fabric quantity has been determined as the small fabric quantity at the primary small fabric quantity determination step; determining whether the fabric quantity value (Q) is higher than a reference value (K) for an excessive fabric quantity determination, when the fabric quantity has not been determined as the small fabric quantity, so as to determine whether the fabric quantity is an excessive fabric quantity; performing an excessive fabric quantity-drying operation, when the fabric quantity has been determined as the excessive fabric quantity at the excessive fabric quantity determination step, the excessive fabric quantity-drying operation including a drying operation carried out until the humidity value is not higher than a predetermined reference value and an additional drying operation following the drying operation; determining whether the fabric quantity value (Q) is lower than a predetermined reference value ($T_8$), when the fabric quantity has not been determined as the excessive fabric quantity, so that a determination is secondarily made about whether the fabric quantity is the small fabric quantity, so as to reduce an error of the fabric quantity determination caused by an ambient temperature; determining the fabric quantity as a large fabric quantity, when the fabric quantity value (Q) has been determined to be equal to or higher than the predetermined reference value ($T_8$) and performing a large fabric quantity-drying operation, based on the temperature variation and the humidity value; and cooling the clothes for a predetermined cooling time under the condition that the heater is turned off, but the motor is driven, after completing the small fabric quantity-drying operation, the large fabric quantity-drying operation or the excessive fabric quantity-drying operation, so as to complete the overall drying operation.

BRIEF DESCRIPTION OF THE DRAWINGS

Other objects and aspects of the invention will become apparent from the following description of embodiments with reference to the accompanying drawings in which:

FIGS. 18A and 18B are characteristic curves illustrating variations in temperature and humidity in the combined sensing type drying operation of the present invention, in which FIG. 18A shows the variations in temperature and humidity depending on operation time, while FIG. 18B shows the temperature variation per unit time depending on the operation time.

DESCRIPTION OF THE PREFERRED EMBODIMENTS

Figure 10:
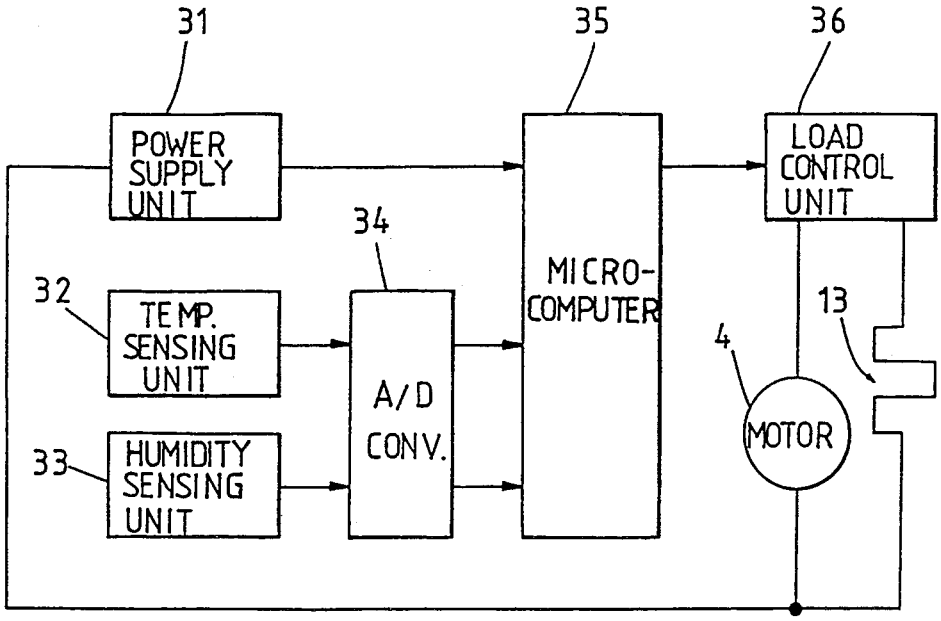
FIG. 10 is a block diagram of a control device for controlling a combined sensing type clothes dryer in accordance with the present invention.

Referring to FIG. 10, there is illustrated a control device for controlling the drying operation of a clothes dryer in accordance with the present invention.

Figure 2:
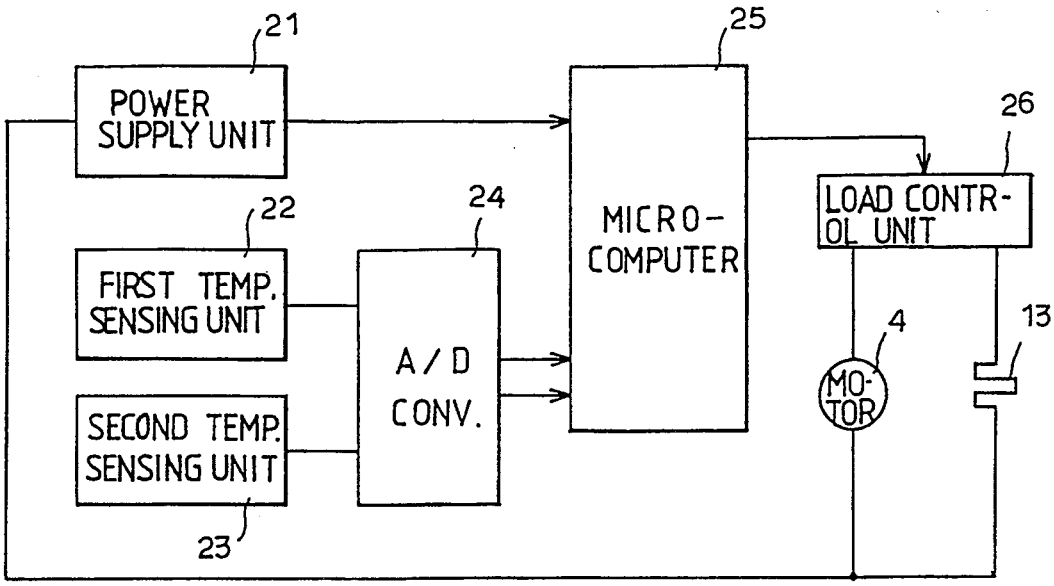
FIG. 2 PRIOR ART
FIG. 2 is a block diagram of a control device for controlling a conventional temperature sensing type clothes dryer.
Figure 3:
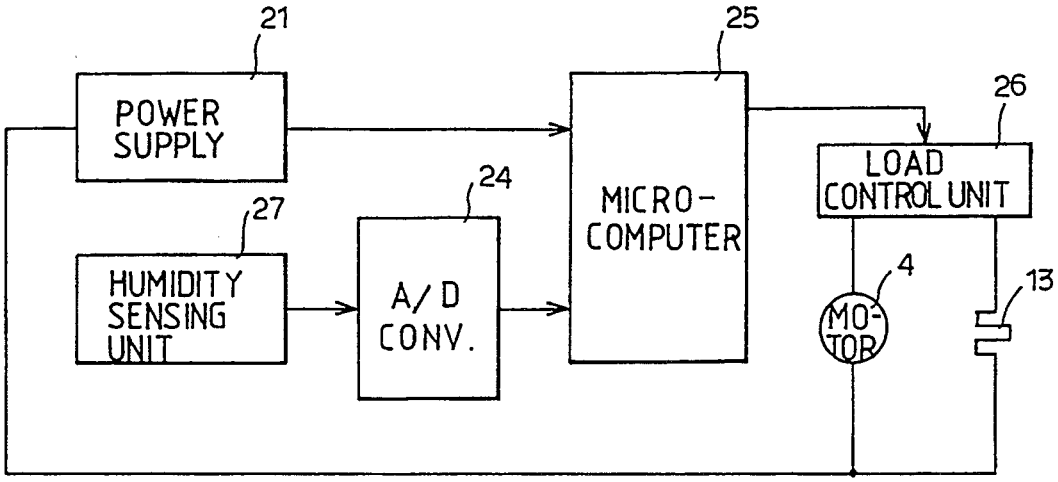
FIG. 3 PRIOR ART
FIG. 3 is a block diagram of a control device for controlling a conventional humidity sensing type clothes dryer.
Figure 4:
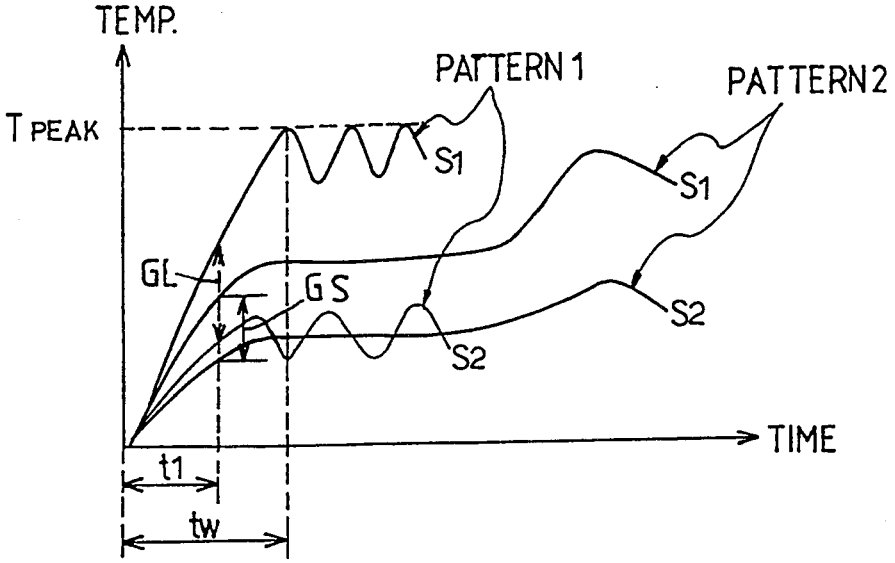
FIG. 4 PRIOR ART
FIG. 4 is characteristic curves illustrating the variations in temperature depending on the drying time in a temperature sensing type control method, in cases of small and large fabric quantities, respectively.
Figure 5:
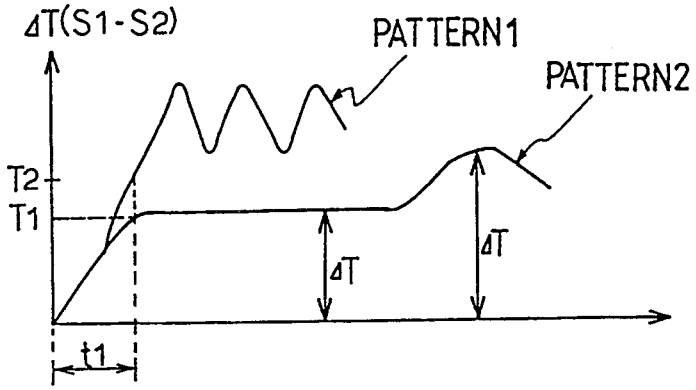
FIG. 5 PRIOR ART
FIG. 5 is characteristic curves illustrating the variations in temperature difference depending on the drying time in the temperature sensing type control method, in cases of small and large fabric quantities, respectively.
Figure 6:
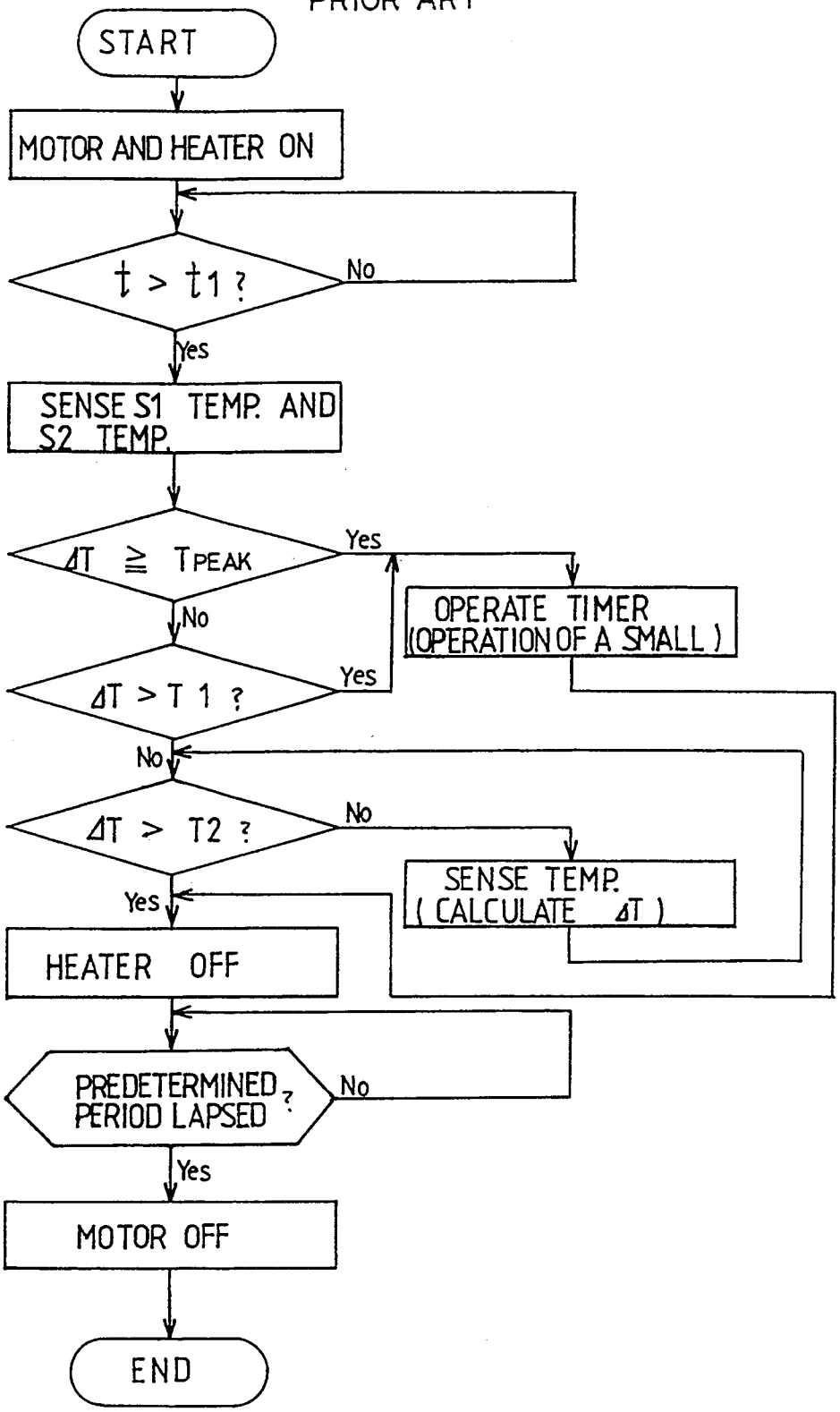
FIG. 6 PRIOR ART
FIG. 6 is a flowchart of the control operation for controlling the drying operation of the temperature sensing type clothes dryer, in accordance with the prior art.
Figure 7:
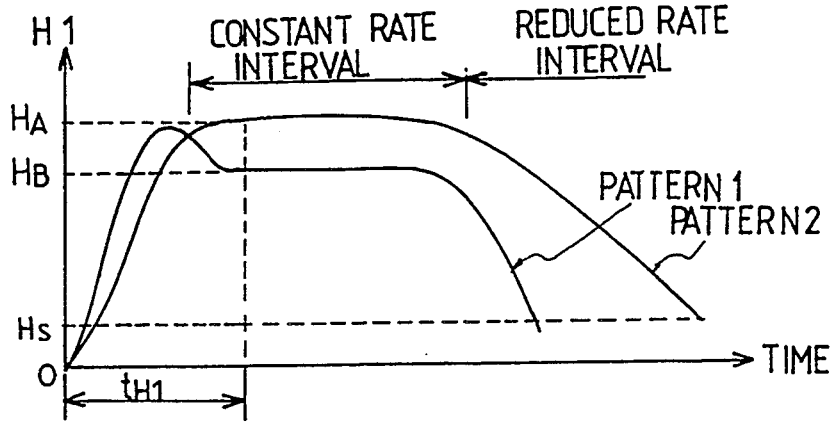
FIG. 7 PRIOR ART
FIG. 7 is characteristic curves illustrating the variations in humidity depending on the drying time in the humidity sensing type control method, in cases of small and large fabric quantities, respectively.
Figure 8:
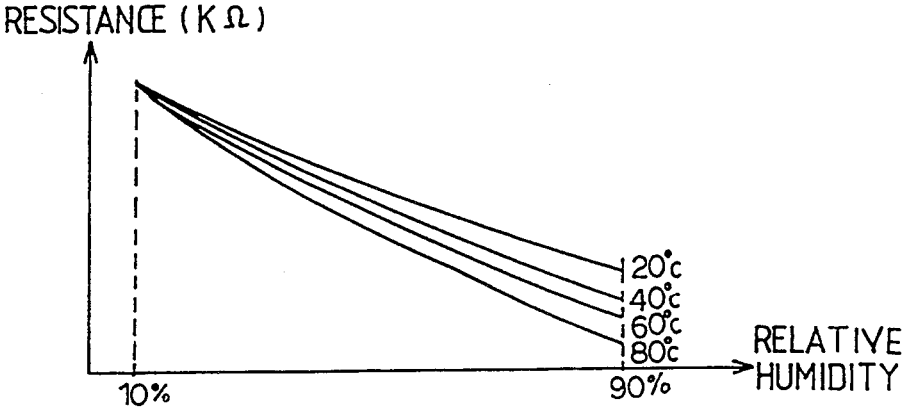
FIG. 8 PRIOR ART
FIG. 8 is characteristic curves illustrating the variations in resistance of a conventional humidity sensor, depending on an ambient temperature.
Figure 9:
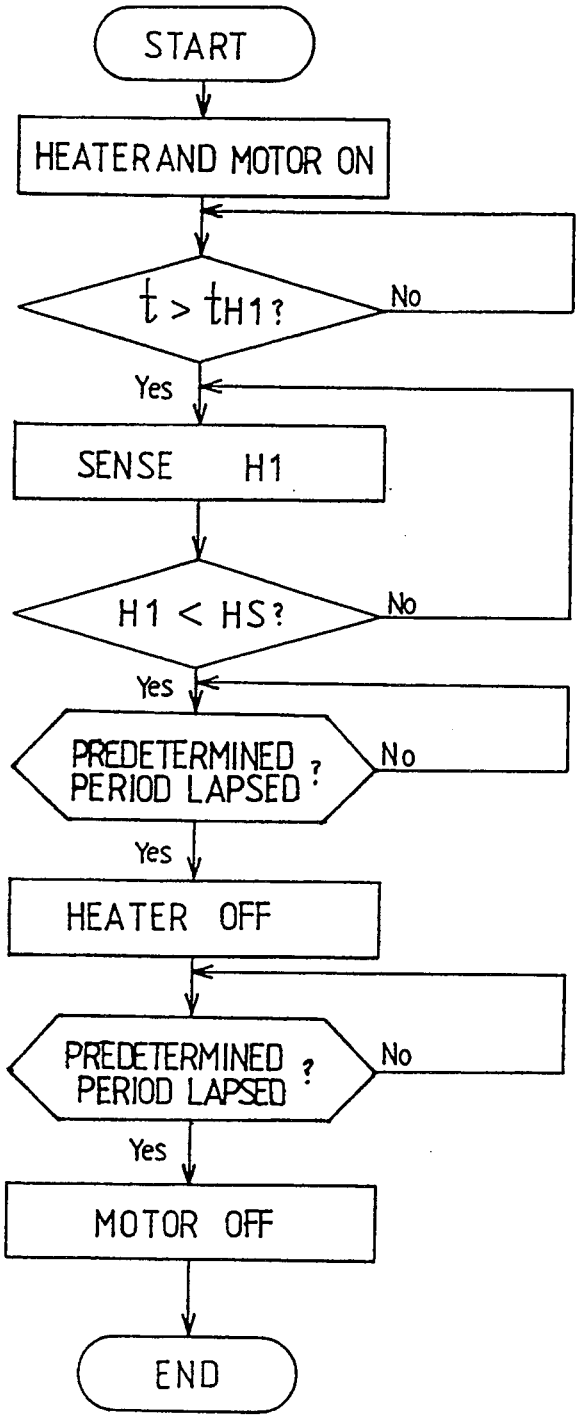
FIG. 9 PRIOR ART
FIG. 9 is a flowchart of the control operation for controlling the drying operation of the humidity sensing type clothes dryer, in accordance with the prior art.

As shown in FIG. 2, the control device comprises an electric power supply unit 31 for supplying electric power to required units of the dryer, a temperature sensing unit 32 for detecting the exhaust air temperature of a dryer drum 2 and thus checking an actual surface temperature of the clothes, a humidity sensing unit 33 for detecting the exhaust air humidity of the drum 2 and thus checking an actual moisture degree of the clothes, an A/D converter 34 for converting output signals from the temperature sensing unit 32 and humidity sensing unit 33 into digital signals, a microcomputer 35 for carrying out the control for the drying operation, based on the sensed temperature value and humidity value from the A/D converter 34, and a load driving unit 36 for driving a motor 4 adapted to drive the drum 2 and a fan 7 and a heater 13 adapted to supply a heat to the interior of drum 2, under the control of the microcomputer 35.

Figure 1:
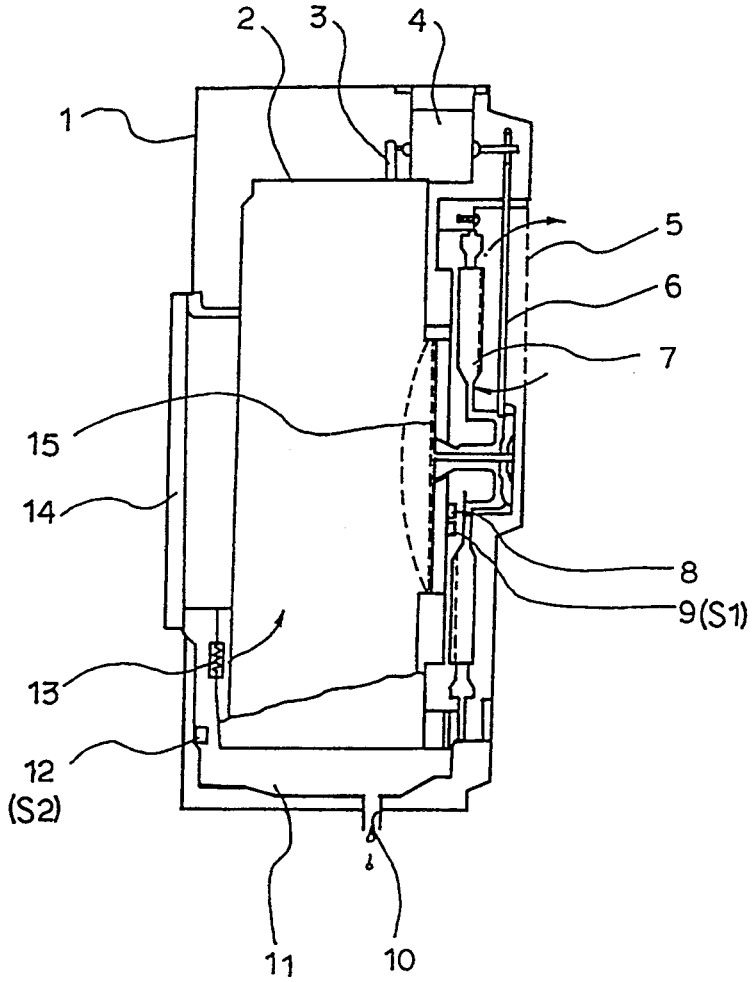
FIG. 1 PRIOR ART
FIG. 1 is a side view of a general construction of a clothes dryer.

In FIG, 10, the same elements as those shown in FIG. 1 such as the motor 4 and the heater 13 are denoted by the same reference numerals. The temperature sensing unit 32 and the humidity sensing unit 33 have a temperature sensor and a humidity sensor which are attached at the same positions as those of the temperature sensor 9 and the humidity sensor 8 of FIG. 1, respectively.

A method for controlling the drying operation of the clothes dryer in accordance with the present invention will be now described.

When wet clothes are to be dried, the user opens a door of the clothes dryer and puts the wet clothes into the drum 2. As the dryer operates, the microcomputer 35 turns on the motor 4 and the heater 13 via the load driving unit 36. As the motor 4 is driven, its torque is transmitted to the drum 2 via a drum belt, thereby causing the drum 2 to rotate. Simultaneously, the torque of motor 4 is also transmitted to the fan via a fan belt, so as to rotate the fan.

Accordingly, the heater 13 emits a heat which is, in turn, supplied to the interior of the drum 2. As a result, the internal temperature of the drum 2 increases and the moisture contained in the clothes is evaporated. Accordingly, air in the drum 2 contains vapor and is exhausted out of the drum 2 via a filter assembly which separates bits of thread and the like from the exhaust air. The hot exhaust air from the drum 2 undergoes an heat exchange with outer cold air introduced into an outer case of the dryer by the rotation of fan. By the heat exchange, the vapor contained in the warm exhaust air is condensed into water which is, in turn, discharged out of a drain port along a duct. The exhaust air from which the moisture is separated is then fed to the heater 13, so as to be circulated to the drum 2 at a heated state. As the air is circulated in a manner as mentioned above, the drying operation is carried out. This drying operation is controlled by the microcomputer 35 in a combined sensing manner, based on the temperature sensed by one temperature sensor and the humidity sensed by one humidity sensor, in accordance with the present invention.

Figure 18A:
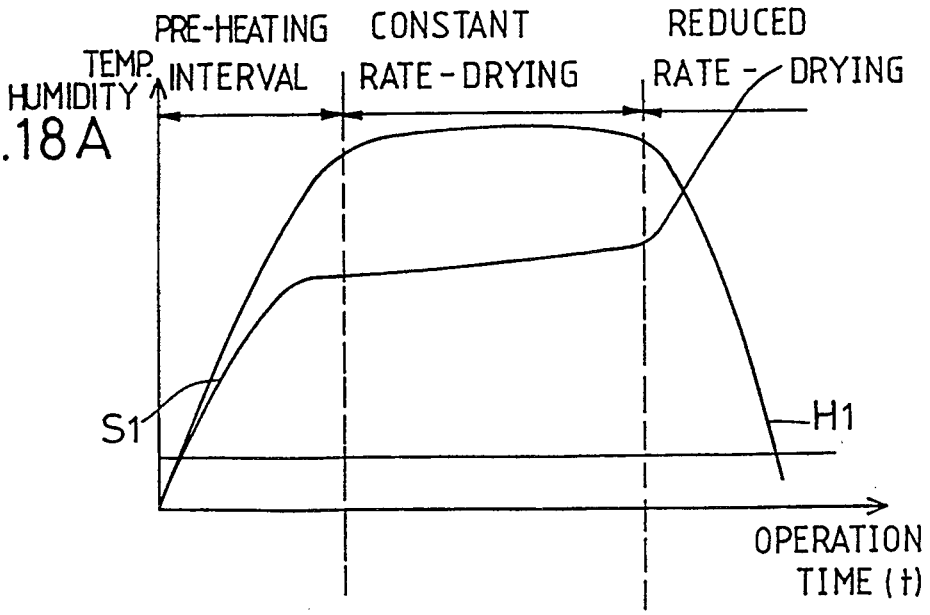
Figure 18B:
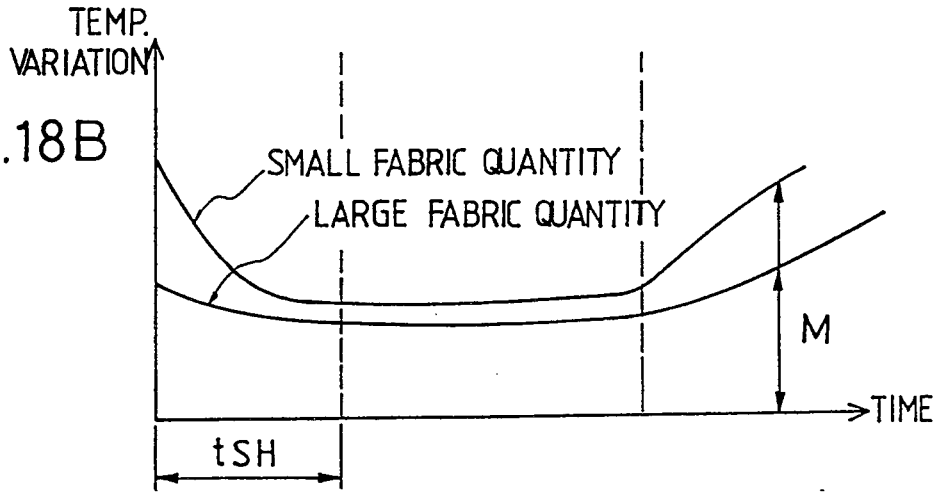

FIGS. 18A and 18B are characteristic curves showing variations in temperature and humidity depending on operation time in the combined sensing type drying operation of the present invention. During the drying operation, the moisture contained in the clothes is continuously evaporated. With the lapse of time, the evaporation amount is gradually increased, as shown in FIG. 18A. By such an increase in evaporation amount, the temperature sensed by the temperature sensor is increased. Also, the humidity sensed by the humidity sensor is also increased as the degree of generating vapor increases. At this time, the sensed value by the temperature sensor increases in a pattern similar to that of the sensed value by the humidity sensor. That is, both the temperature and the humidity are sharply increased for a predetermined pre-heating time $t_{SH}$ from the beginning of the drying operation. When the pro-heating time $t_{SH}$ has been elapsed, the evaporation amount is proportional to the emitted heat amount of the heater 13 so that the temperature and the humidity are kept in equilibrium. Accordingly, a drying at a constant rate is continued for a certain time. Thereafter, the humidity is sharply decreased, while the temperature is increased. That is, a drying at a reduced rate is carried out.

As shown in FIG. 18B, the temperature variation per unit time is very small at the constant rate-drying interval and large at the reduced rate-drying interval. In particular, the temperature variation is large at a large fabric quantity, as compared with a small fabric quantity.

Figure 14:
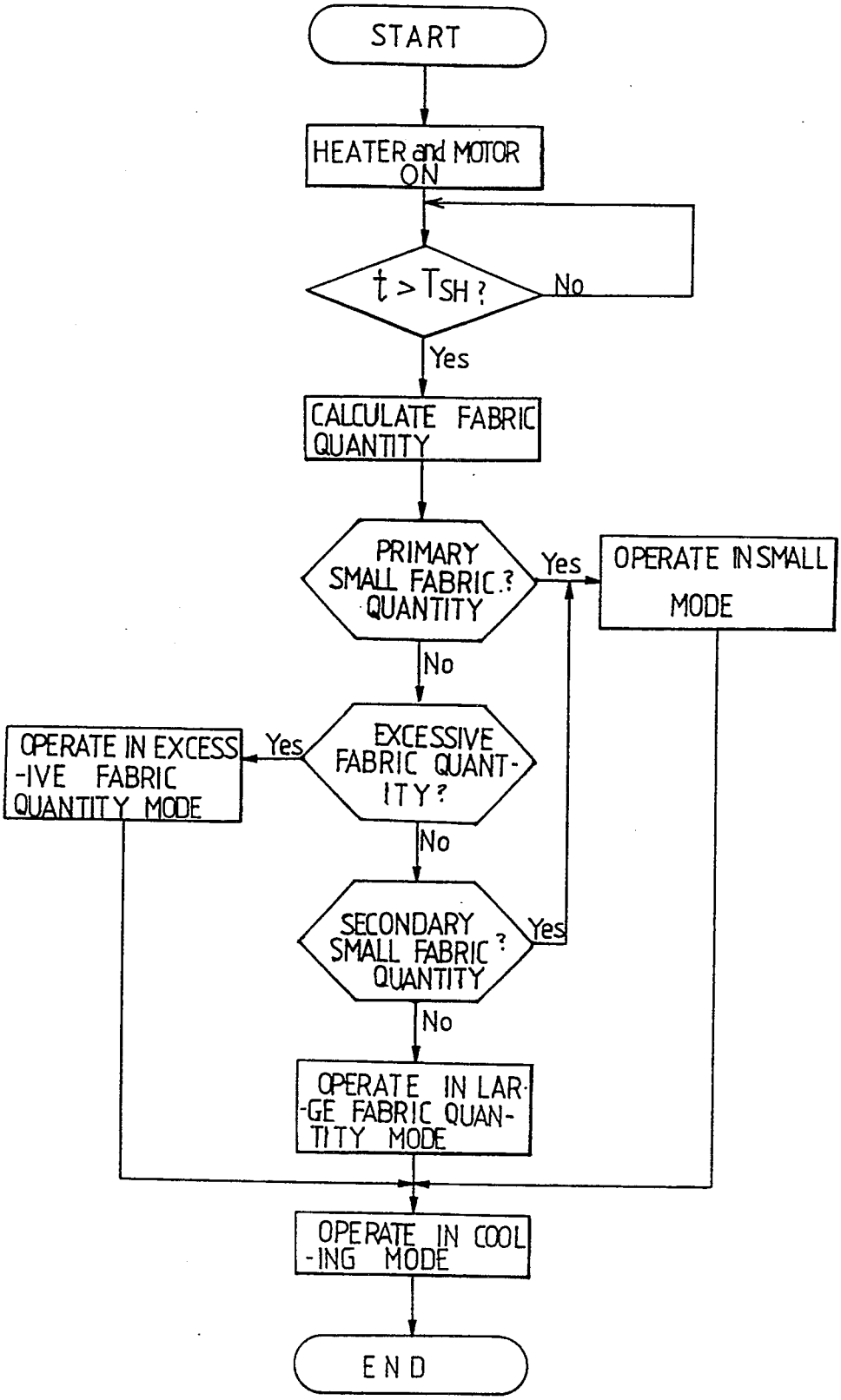
FIG. 14 is a flowchart of the control operation for controlling the drying operation of the combined sensing type clothes dryer, in accordance with the present invention.

Accordingly, the microcomputer 35 senses both the temperature and the humidity via the temperature sensing unit 32 and the humidity sensing unit 33 and controls the drying operation, based on the sensed temperature variation and the sensed humidity, according to the procedures shown in FIG. 14.

Now, the combined sensing type control method carried out under the control of the microcomputer 35 will be described. As the clothes dryer operates, the microcomputer 35 turns on the heater 13 and the motor 4 and checks the drying operation time t, so as to carry out a step of checking whether a predetermined time $t_{SH}$ has been elapsed. The predetermined time $t_{SH}$ is a reference time calculated experimentally and set for determining the fabric quantity. The predetermined time $t_{SH}$ corresponds a period of time between the point of the operation beginning point and the point of time just before the humidity value reaches its maximum value of, for example, 90% and the temperature value reaches its peak value, irrespective of the fabric quantity.

When the drying operation time t exceeds the predetermined time $t_{SH}$, the microcomputer 35 performs a procedure of calculating a value Q indicative of the fabric quantity, based on the temperature variation $\Delta X$ per unit time and the humidity value H1.

Figure 15:
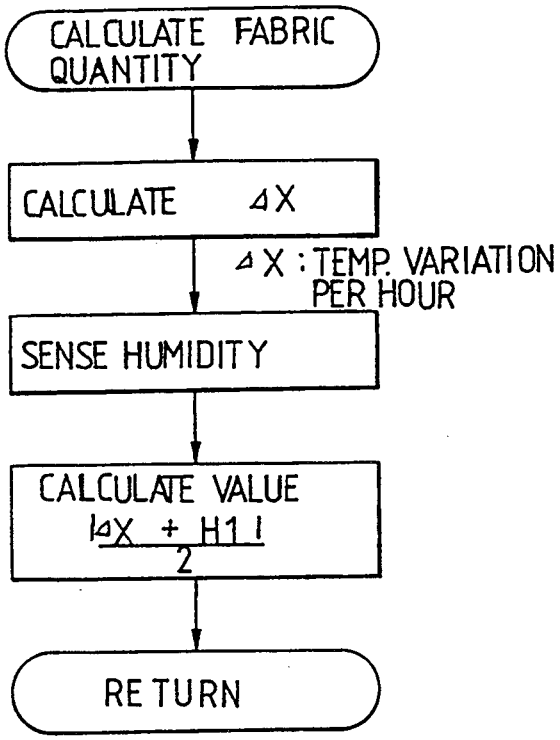
FIG. 15 is a flowchart of a fabric quantity calculation step of the control operation according to the present invention.

For calculating the fabric quantity, first, the temperature of the air exhausted out of the drum is sensed for calculating the temperature variation $\Delta X$ per unit time, as shown in FIG. 15. Thereafter, a step of sensing the humidity of the air exhausted out of the drum is carried out. Thereafter, the fabric quantity value Q is calculated by dividing the absolute sum ($|H1+\Delta X|$) of the humidity value H1 and the temperature variation $\Delta X$ by 2.

In the drying operation control method of the conventional type of determining the fabric quantity, based on the temperature difference between the exhaust air temperature and the intake air temperature, there may be an error, since the temperature difference is greatly affected by the ambient temperature around the dryer.

The present invention adopts a method capable of compensating such an error.

The temperature variation $\Delta X$ per unit time is the exhaust air temperature variation which is less affected by the ambient temperature, as compared with the intake air temperature variation. However, it is true that the temperature variation $\Delta X$ is slightly affected by the ambient temperature. Accordingly, the present invention compensates this effect by sensing the humidity.

Figure 11:
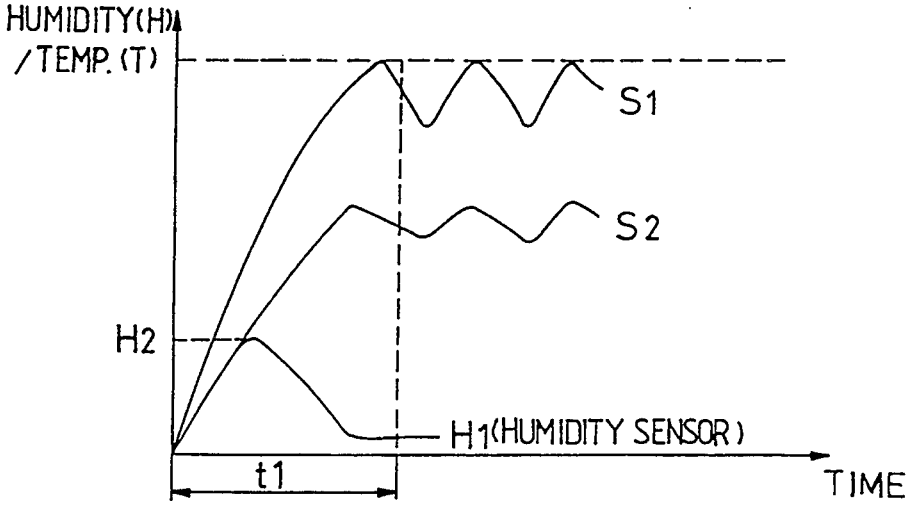
FIG. 11 is characteristic curves illustrating variations in temperature and humidity at a small fabric quantity in a combined sensing type control method according to the present invention.

As shown in FIG. 11, there is a great difference between the temperature variation per unit time at a small fabric quantity and the temperature variation per unit time at a large fabric quantity, in both the pre-heating interval and the reduced rate-drying interval. Where the fabric quantity is determined, based on the temperature variation per unit time and the humidity value, accordingly, the error of the fabric quantity determination can be substantially reduced, without an additional compensation which is achieved by detecting the ambient temperature.

The reason why the error of the fabric quantity determination due to the ambient temperature can be compensated by the humidity value will be apparent from the following description.

Figure 13:
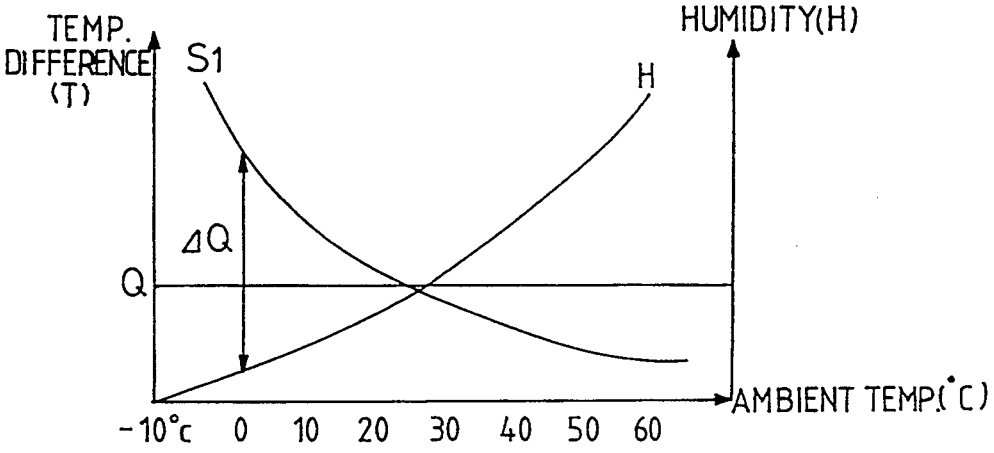
FIG. 13 is characteristic curves illustrating variations in temperature and humidity depending on an ambient temperature at a constant fabric quantity in the combined sensing type control method according to the present invention.

As shown in FIG. 13, the temperature variation $\Delta X$ becomes higher at a lower ambient temperature and lower at a higher ambient temperature. On the other hand, the humidity value becomes lower at a lower ambient temperature and higher at a higher ambient temperature. That is, the temperature variation and the humidity value, depending the ambient temperature, are inversely proportional to each other. The curves of the temperature variation and the humidity value are also symmetrical. At a constant fabric quantity, accordingly, the fabric quantity value Q is constant, irrespective of the ambient temperature.

As mentioned above, the temperature variation is lower at a larger fabric quantity and higher at a smaller fabric quantity. On the other hand, the humidity value is higher at a larger fabric quantity and lower at a smaller fabric quantity. The humidity value reaches the maximum value at a higher rate when the fabric quantity is smaller, but at a lower rate when the fabric quantity is larger. However, the humidity value keeps a constant value, irrespective of the fabric quantity, until a certain time is elapsed after it reached the maximum value. At the constant rate-drying interval, the humidity value is slightly varied, depending on the fabric quantity. The humidity value sensed at the point of time when the predetermined time $t_{SH}$ has been elapsed after the beginning of the drying operation is also varied, depending on the ambient temperature. However, such a variation is as small as negligible, as compared with the temperature variation.

Accordingly, the fabric quantity value Q calculated by dividing the absolute sum of the humidity value and the temperature variation by 2 is independent of the ambient temperature and dependent on only the fabric quantity. That is, the fabric quantity value Q is lower at a smaller fabric quantity and higher at a higher fabric quantity.

In accordance with the present invention, therefore, the error of the fabric quantity determination due to the ambient temperature is compensated by determining the fabric quantity, based on the fabric quantity value Q which is independent of the ambient temperature and dependent on only the fabric quantity.

After the above-mentioned calculation of the fabric quantity value Q, the microcomputer performs a procedure of primarily determining whether the fabric quantity corresponds to a small fabric quantity, based on the calculated fabric quantity value Q.

Figure 16:
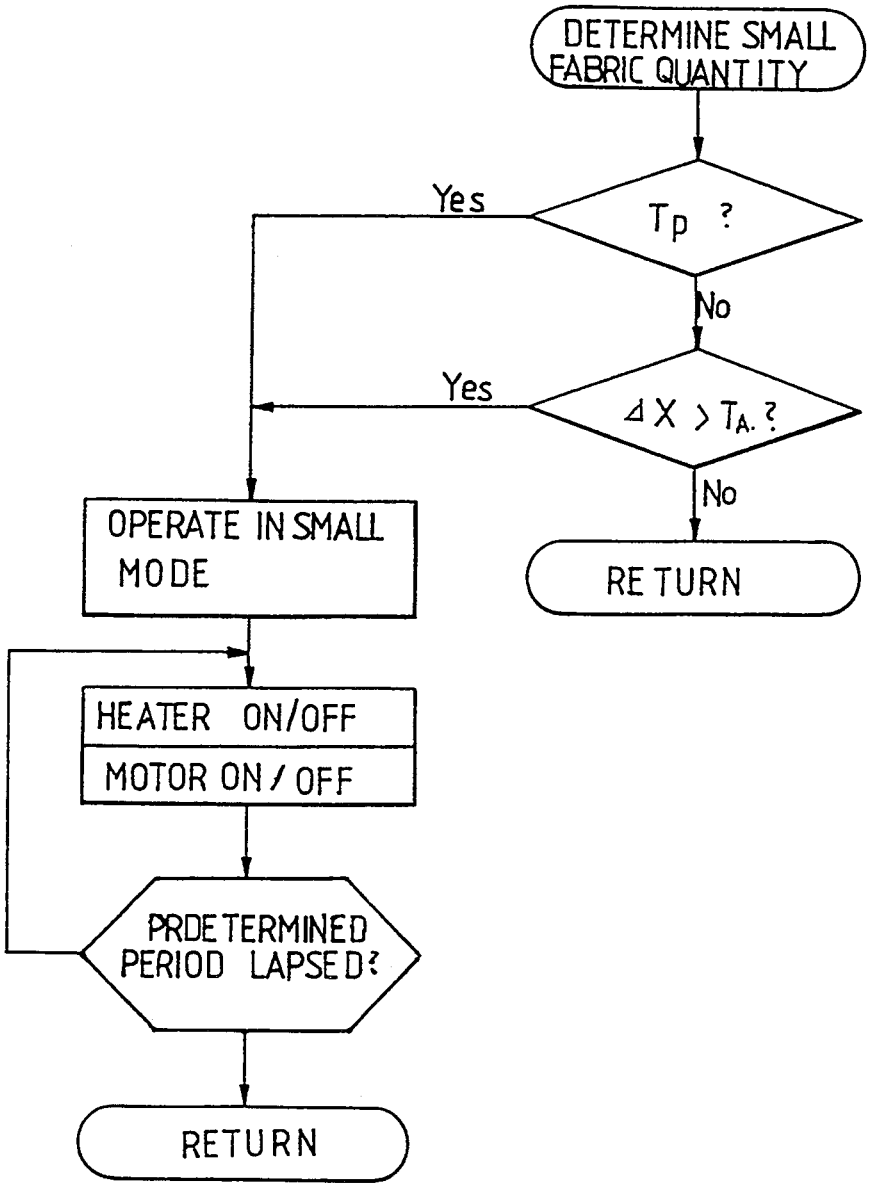
FIG. 16 is a flowchart of a small fabric quantity determination step and a small fabric quantity-drying operation step of the control operation according to the present invention.

For carrying out the primary small fabric quantity determination procedure, first, a determination is made about whether the currently sensed temperature has reached the peak temperature $t_p$, as shown in FIG. 16. When the currently sensed temperature has reached the peak temperature $t_p$, the fabric quantity is determined as a small fabric quantity. When the currently sensed temperature is lower than the peak temperature $t_p$, a determination is made about whether the temperature variation $\Delta X$ is larger than a reference value $T_A$ predetermined for the small fabric quantity determination. The fabric quantity is determined as a small fabric quantity, when the temperature variation $\Delta X$ is larger than a reference value $T_A$. At such a small fabric quantity, the microcomputer carries out a procedure of performing a small fabric quantity-drying operation by turning on/-off the motor for a predetermined time.

The reason why the determination is made about whether the currently sensed temperature has reached the peak temperature $t_p$ at which the heater is controlled will be apparent from the following description.

When the fabric quantity is very small, the humidity value sensed after the predetermined time $t_{SH}$ has been elapsed can not be used. This is because the humidity sensing is badly and inaccurately achieved, in that the humidity value is sharply decreased to a level which the humidity sensor 8 senses, under the above-mentioned condition. However, the temperature variation per unit time is higher at a smaller fabric quantity. Accordingly, the small fabric quantity determination is achieved by determining whether the temperature sensed by the temperature sensor has reached the peak temperature $t_p$. When the temperature sensed by the temperature sensor has not reached the peak temperature $t_p$, a determination is also made about whether the temperature variation $\Delta X$ is higher than the reference value $T_A$ predetermined for the small fabric quantity determination. When the fabric quantity has been determined as the small fabric quantity, the small fabric quantity-drying operation is carried out by turning on/off the motor for a predetermined time, until the drying degree is not less than 97%.

The reason why the heater is turned on/off when the fabric quantity has been determined as the small fabric quantity is to prevent any damage to the clothes. The heater is turned off when the sensed temperature has reached the peak temperature $t_p$ and turned on when the sensed temperature is lower than a predetermined temperature. In the latter case, the heater is turned on, to control the drying operation.

Figure 17:
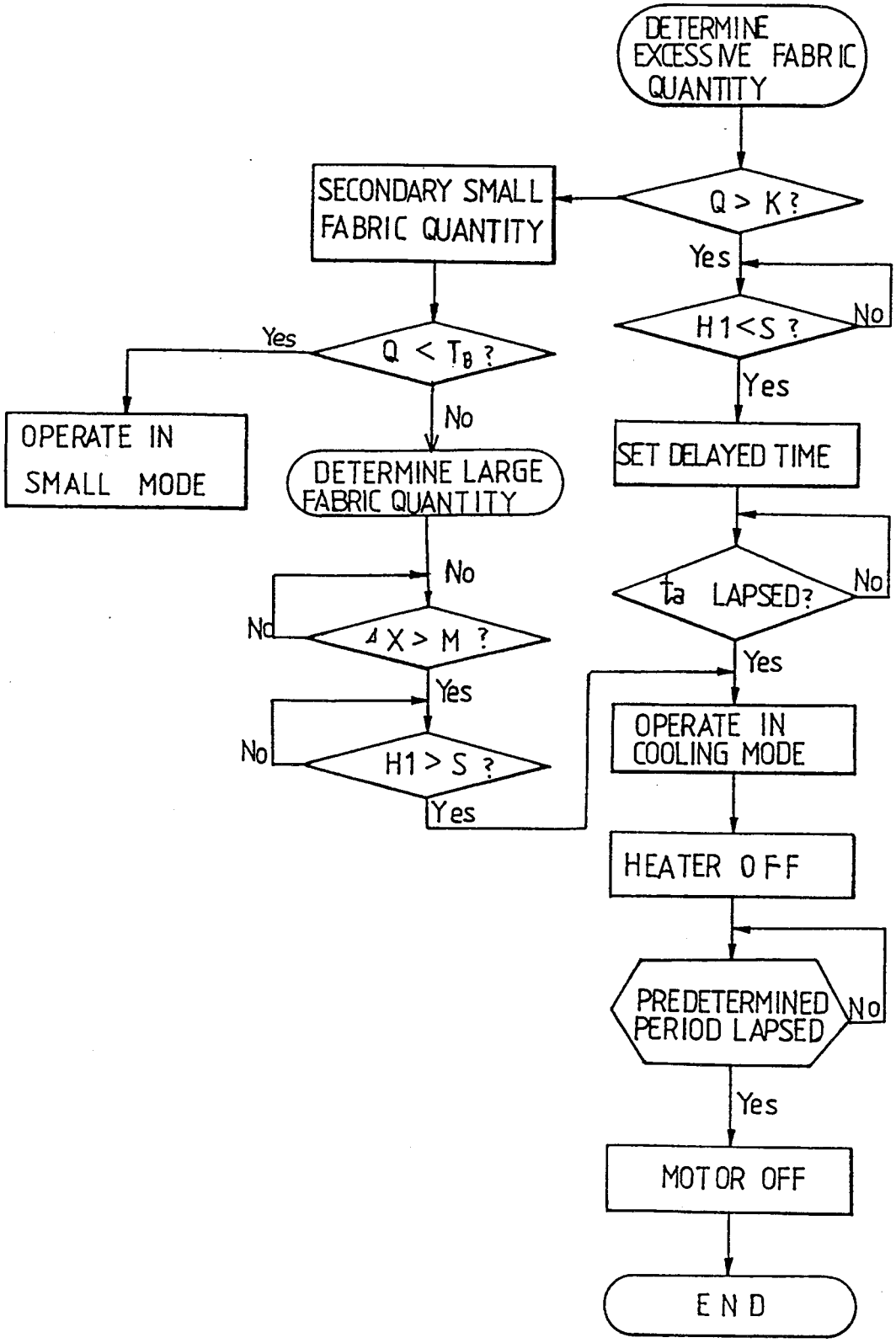
FIG. 17 is a flowchart of an excessive fabric quantity determination step and an excessive fabric quantity-drying operation step of the control operation according to the present invention.

When the fabric quantity has not been determined as the small fabric quantity at the small fabric quantity determination procedure, the microcomputer carries out a procedure of determining whether the fabric quantity is an excessive fabric quantity, as shown in FIG. 17. The excessive fabric quantity determination is achieved by determining whether the calculated fabric quantity value Q is higher than a reference value K for the excessive fabric quantity determination. When the fabric quantity has been determined as the excessive fabric quantity, an excessive fabric quantity-drying operation is carried out. The excessive fabric quantity-drying operation is achieved by carrying out a step of performing the drying operation until the humidity value H1 is not more than a humidity sensing limit S and then a step of additionally performing the drying operation for an additional delayed operation time ta corresponding to the excessive fabric quantity.

Figure 12:
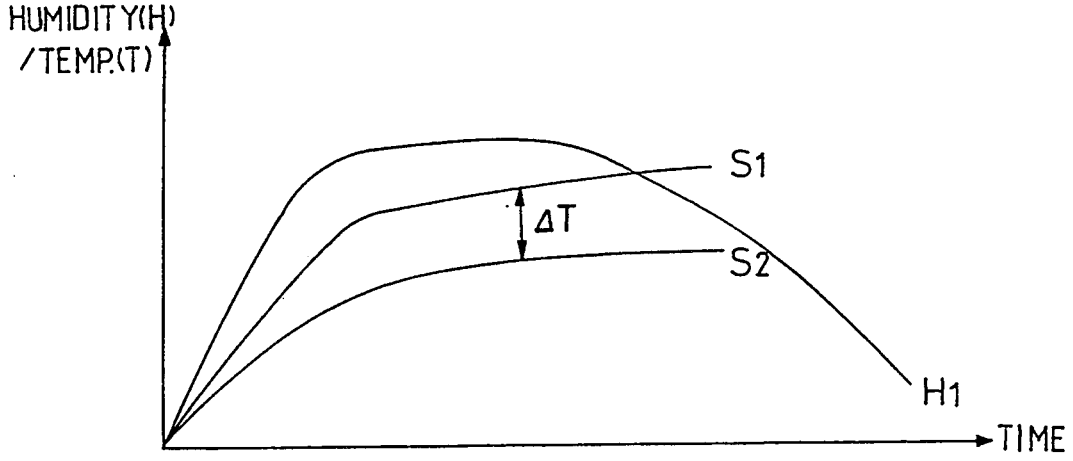
FIG. 12 is characteristic curves illustrating variations in temperature and humidity at a large fabric quantity in the combined sensing type control method according to the present invention.

At such an excessive fabric quantity, the difference between the exhaust air temperature and the intake air temperature does not appear, as shown in FIG. 12, since the heat emitted from the heater is shielded by the clothes of the excessive fabric quantity. As a result, it is actually impossible to detect the completion of drying by the temperature sensor. In case of the humidity sensor, however, it is possible to check the humidity, in that the vapor evaporated by the heat from the heater can reach the vicinity of the humidity sensor, even though the heat from the heater is not transmitted to the temperature sensor.

When the fabric quantity is excessive, accordingly, the drying operation is controlled, based on only the humidity value sensed by the humidity sensor, to be performed until the humidity value H1 is not more than a humidity sensing limit S. Thereafter, the drying operation is additionally performed for the additional operation time ta, so as to further increase the drying degree. The operation time ta is checked using a timer. After the additional operation time ta has elapsed, the drying operation is completed.

When the fabric quantity value Q has been determined to be equal to or lower than the reference value K for the excessive fabric quantity determination at the excessive fabric quantity determination procedure, that is, when the fabric quantity is not excessive, a determination is made about whether the fabric quantity value Q is higher than a reference value $T_8$ predetermined for the small fabric quantity determination. When the fabric quantity has been determined as the small fabric quantity, a secondary small fabric quantity-drying operation is carried out. By the secondary small fabric quantity determination, the fabric quantity is checked again, based on the fabric quantity Q which is constant at a constant fabric quantity, irrespective of the ambient temperature, so as to reduce the error of the fabric quantity determination.

When the fabric quantity value Q is higher than the reference value $T_8$, that is, at the large fabric quantity, a large fabric quantity-drying operation is carried out. For achieving the large fabric quantity-drying operation, first, the drying operation is carried out until the temperature variation X is higher than a predetermined reference value M. After the temperature variation $\Delta X$ is higher than the predetermined reference value M, a determination is made about whether the humidity value H1 is lower than the humidity sensing limit S for determining the completion of drying. Based on this determination, the drying operation is continued, until the humidity value H1 is lower than the humidity sensing limit S. The reason why both the temperature variation and the humidity are checked is to prevent an insufficient drying at a large fabric quantity.

After the small fabric quantity-drying operation, the large fabric quantity-drying operation or the excessive fabric quantity-drying operation has been achieved, the heater is turned off. Thereafter, only the motor is driven for a predetermined time, so as to carry out a cooling operation for cooling the heated clothes. Thus, the drying operation is completed.

As apparent from the above description, the present invention provides a method for controlling the drying operation, capable of checking the completion point of drying, irrespective of the fabric quantity and thus reducing the drying time. The control method of the present invention eliminates the requirement of an additional sensor for compensating an error of the fabric quantity determination due to an ambient temperature. By the double fabric quantity determination, the control method of the present invention also compensates an insufficient drying which may be possibly generated in the conventional control methods of both the temperature sensing type and the humidity sensing type. Accordingly, it is possible to prevent an occurrence of the insufficient drying.

Although the preferred embodiments of the invention have been disclosed for illustrative purposes, those skilled in the art will appreciate that various modifications, additions and substitutions are possible, without departing from the scope and spirit of the invention as disclosed in the accompanying claims.

What is claimed is:

1. A method for determining a fabric quantity of clothes being dried in a drum of a dryer having a heat exchanging fan, a motor for driving said drum, a heater and a microcomputer for controlling the drying operation, comprising the steps of:

turning on said heater and said motor at the beginning of said drying operation;

checking whether a predetermined time has lapsed since the beginning of the drying operation;

obtaining a temperature variation per unit time and a humidity value of the air exhausted out of said drum by said heat exchanging fan, when said predetermined time is checked to have lapsed;

calculating an arithmetical mean of said temperature variation per unit time and said humidity value;

comparing said calculated arithmetical mean with a plurality of reference values experimentally predetermined; and determining said fabric quantity of clothes being dried in said drum in accordance with said comparison.

2. A method for controlling a drying operation of a clothes dryer including a drum, a heat exchanging fan, a motor, a heater and a microcomputer for controlling the drying operation, comprising the steps of:

turning on the heater and the motor at the beginning of the drying operation and checking a drying operation time t, to determine whether the drying operation time t has exceeded a predetermined time $t_{SH}$;

calculating a value Q indicative of the fabric quantity, based on a temperature variation $\Delta X$ per unit time and a humidity value of exhaust air, when the drying operation time t has exceeded the predetermined time $t_{SH}$;

primarily determining whether the fabric quantity corresponds to a small fabric quantity, based on a currently sensed temperature and the temperature variation $\Delta X$, after the calculation of the fabric quantity value Q;

performing a small fabric quantity-drying operation by turning the motor on for a predetermined time, when the fabric quantity has been determined as the small fabric quantity at the primary small fabric quantity determination step;

determining whether the fabric quantity value Q is higher than a first reference value K for an excessive fabric quantity determination, when the fabric quantity has not been determined as the small fabric quantity, so as to determine whether the fabric quantity is an excessive fabric quantity;

performing an excessive fabric quantity-drying operation, when the fabric quantity has been determined as the excessive fabric quantity at the excessive fabric quantity determination step, the excessive fabric quantity-drying operation including a drying operation carried out until the humidity value is not higher than a third predetermined reference value and carrying out an additional drying operation following the excessive fabric quantity-drying operation;

determining whether the fabric quantity value Q is lower than a second predetermined reference value $T_8$, when the fabric quantity has not been determined as the excessive fabric quantity, so that a determination is secondarily made about whether the fabric quantity is the small fabric quantity, so as to reduce an error of fabric quantity determination caused by an ambient temperature;

determining the fabric quantity as a large fabric quantity, when the fabric quantity value Q has been determined to be equal to or higher than the second predetermined reference value $T_8$ and performing a large fabric quantity-drying operation, based on the temperature variation and the humidity value; and cooling the clothes for a predetermined cooling time under the condition that the heater is turned off, but the motor is driven, after completing the small fabric quantity-drying operation, the large fabric quantity-drying operation or the excessive fabric quantity-drying operation, so as to complete the overall drying operation.

3. A method in accordance with claim 2, wherein the step of calculating the fabric quantity value Q comprises the steps of:

calculating the temperature variation $\Delta X$ per unit time by sensing the temperature of air exhausted out of the drum;

sensing the humidity of the air exhausted out of the drum; and calculating the fabric quantity value Q by the absolute sum of the humidity value and the temperature variation $\Delta X$.

4. A method in accordance with claim 2, wherein the primary small fabric quantity determination step comprises the steps of:

determining the fabric quantity as the small fabric quantity when the exhaust air temperature has reached a peak temperature $t_p$ before the drying operation time t exceeds the predetermined time $t_{SH}$; and determining the fabric quantity as the small fabric quantity when the temperature variation $\Delta X$ is larger than a reference value $T_A$, even though the exhaust air temperature does not reach the peak temperature $t_p$ until the drying operation time t exceeds the predetermined time $t_{SH}$.

5. A method in accordance with claim 2, wherein the small fabric quantity-drying operation is achieved by driving the drum for a defined time period and the heat exchanging fan at predetermined intervals and turning the heater on for time durations such that the exhaust air temperature is kept between a predetermined temperature and a peak temperature, for a predetermined time.

6. A method in accordance with claim 2, wherein the excessive fabric quantity-drying operation comprises the steps of:

performing the excessive fabric quantity-drying operation until the humidity value is not higher than a humidity sensing limit S predetermined for completing the excessive fabric quantity-drying operation; and additionally performing the excessive fabric quantity-drying operation for a predetermined additional operation time ta corresponding to the excessive fabric quantity.

7. A method in accordance with claim 2, wherein the large fabric quantity-drying operation comprises the steps of:

performing the large fabric quantity-drying operation until the temperature variation $\Delta X$ is higher than a predetermined reference value M; and performing the large fabric quantity-drying operation until the humidity value is lower than a humidity sensing limit S for completing the large fabric quantity-drying operation, after the temperature variation $\Delta X$ has been higher than the predetermined reference value M.

8. A method for controlling a drying operation of a clothes dryer having a heat exchanging fan, a motor for driving a drum and a heater, in accordance with a fabric quantity of clothes being dried, comprising the steps of:

turning on said heater and said motor at the beginning of said drying operation;

checking whether a predetermined time $t_{SH}$ has lapsed since the beginning of the drying operation;

obtaining a temperature variation per unit time and a humidity value of the air being exhausted out of said drum by said heat exchanging fan, when said predetermined time $t_{SH}$ is checked to have lapsed;

calculating an arithmetical mean of said temperature variation per unit time and said humidity value;

determining a fabric quantity value based on said calculating step;

primarily determining whether the fabric quantity corresponds to a small fabric quantity, based on a currently sensed temperature and the temperature variation, after the calculation of the fabric quantity value;

performing a small quantity-drying operation by controlling the motor for a predetermined time, when the fabric quantity has been determined as the small fabric quantity at the primary small fabric quantity determination step;

determining whether the fabric quantity value is higher than a first reference value k for an excessive fabric quantity determination, when the fabric quantity has not been determined as the small fabric quantity, so as to determine whether the fabric quantity is an excessive fabric quantity;

performing an excessive quantity-drying operation, when the fabric quantity has been determined as the excessive fabric quantity at the excessive fabric quantity determination step, the excessive fabric quantity-drying operation including a drying operation carried out until the humidity value is not higher than a third predetermined reference value and carrying out an additional drying operation following the excessive fabric quantity-drying operation;

determining whether the fabric quantity value is lower than a second predetermined reference value $T_B$, when the fabric quantity has not been determined as the excessive fabric quantity, so that a determination is secondarily made about whether the fabric quantity is the small fabric quantity, so as to reduce an error of fabric quantity determination caused by an ambient temperature;

determining the fabric quantity as a large fabric quantity, when the fabric quantity value has been determined to be equal to or higher than the second predetermined reference value $t_B$ and performing a large fabric quantity-drying operation, based on the temperature variation and the humidity value; and cooling the clothes for a predetermined cooling time with the heater turned off, and the motor being driven, after completing the small fabric quantity-drying operation, the large fabric quantity-drying operation or the excessive fabric quantity-drying operation, so as to complete the overall drying operation.

9. A method in accordance with claim 8, wherein the step of calculating the fabric quantity value comprises the steps of:

calculating the temperature variation per unit time by sensing the temperature of air exhausted out of the drum;

sensing the humidity of the air exhausted out of the drum; and calculating the fabric quantity value by the absolute sum of the humidity and the temperature variation.

10. A method in accordance with claim 8, wherein the primary small fabric quantity determination step comprises the steps of:

determining the fabric quantity as the small fabric quantity when the exhaust air temperature has reached a peak temperature $t_p$ before a drying operation time t exceeds the predetermined time $t_{SH}$; and determining the fabric quantity as the small fabric quantity when the temperature variation is larger than a reference value Thd A, even though the exhaust air temperature does not reach the peak temperature $t_p$ until the drying operation time t exceeds the predetermined time $t_{SH}$.

11. A method in accordance with claim 8, wherein the small fabric quantity-drying operation is achieved by driving the drum for a defined time period and the heat exchanging fan at predetermined intervals and turning the heater on such that the exhaust air temperature is kept between a predetermined temperature and a peak temperature, for a predetermined time.

12. A method in accordance with claim 8, wherein the excessive fabric quantity-drying operation comprises the steps of:

performing the excessive fabric quantity-drying operation until the humidity value is not higher than a humidity sensing limit S predetermined for completing the excessive fabric quantity-drying operation; and additionally performing the excessive fabric quantity-drying operation for a predetermined additional operation time ta corresponding to the excessive fabric quantity.

13. A method in accordance with claim 8, wherein the large fabric quantity-drying operation comprises the steps of:

performing the large fabric quantity-drying operation until the temperature variation is higher than a predetermined reference value M; and performing the large fabric quantity-drying operation until the humidity value is lower than a humidity sensing limit S for completing the large fabric quantity-drying operation, after the temperature variation has been higher than the predetermined reference value M.

* * * * *